US011473462B1

(12) United States Patent
Woods et al.

(10) Patent No.: US 11,473,462 B1
(45) Date of Patent: Oct. 18, 2022

(54) WATER DROP MUFFLER FOR DIESEL POWERED MARINE GENERATOR

(71) Applicants: Woodrow Woods, Riviera Beach, FL (US); Darrin Woods, Riviera Beach, FL (US)

(72) Inventors: Woodrow Woods, Riviera Beach, FL (US); Darrin Woods, Riviera Beach, FL (US)

( * ) Notice: Subject to any disclaimer, the term of this patent is extended or adjusted under 35 U.S.C. 154(b) by 160 days.

(21) Appl. No.: 17/097,515

(22) Filed: Nov. 13, 2020

Related U.S. Application Data

(60) Provisional application No. 62/937,507, filed on Nov. 19, 2019.

(51) Int. Cl.
*F01N 1/08* (2006.01)
*F01N 13/00* (2010.01)

(52) U.S. Cl.
CPC ..... *F01N 1/083* (2013.01); *F01N 1/089* (2013.01); *F01N 13/004* (2013.01); *F01N 2590/02* (2013.01)

(58) Field of Classification Search
CPC ..... F01N 1/083; F01N 1/089; F01N 13/004; F01N 2590/02
See application file for complete search history.

(56) References Cited

U.S. PATENT DOCUMENTS 5,196,655 A 3/1993 Woods
5,262,600 A 11/1993 Woods
5,444,196 A 8/1995 Woods
5,504,280 A 4/1996 Woods
5,616,893 A 4/1997 Woods
5,625,173 A 4/1997 Woods
6,564,901 B2 5/2003 Woods
7,581,620 B2 9/2009 Woods et al.
7,905,322 B2 3/2011 Woods et al.
7,942,238 B2 5/2011 Woods et al.
8,246,403 B2 8/2012 Woods et al.
8,992,275 B1 3/2015 Woods et al.
9,273,588 B1 * 3/2016 Woods ..... F01N 13/08
9,562,450 B1 2/2017 Woods et al.
9,873,497 B1 1/2018 Woods et al.
10,308,339 B1 6/2019 Woods et al.
2002/0020581 A1 * 2/2002 Smullin ..... B63H 21/383 181/235

* cited by examiner

*Primary Examiner* — Audrey B. Walter
(74) *Attorney, Agent, or Firm* — Mark D. Bowen, Esq.; Malin Haley DiMaggio & Bowen, P.A.

(57) ABSTRACT

A marine muffler includes a housing having a wet exhaust inlet, a water outlet, and a dry exhaust outlet. An internal chamber is divided by an angularly disposed baffle into lower and upper chambers. Vertical exhaust ducts penetrate the baffle and function to allow exhaust gas and entrained cooling water to pass from the lower chamber into the upper chamber. The second chamber is bounded at the top a second baffle which terminates the upward flow of exhaust thereby redirecting the exhaust downward. A pair of exhaust conduits extend through the second baffle thereby allowing exhaust to pass upward and into a third chamber which is bounded at it's uppermost portion by a third baffle defining a plurality of slotted apertures in fluid communication with the exhaust outlet. Water separated from the exhaust gas is directed to the water outlet by the diagonal baffle whereby it exits the housing.

13 Claims, 5 Drawing Sheets

WATER DROP MUFFLER FOR DIESEL POWERED MARINE GENERATOR

CROSS REFERENCE TO RELATED APPLICATIONS

This application claims the benefit of provisional U.S. Patent Application Ser. No. 62/937,507, filed on Nov. 19, 2019.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to marine exhaust systems for use with internal combustion marine engines and generators, and more particularly to an improved four-stage water-drop muffler particularly suited for use with a diesel-powered marine generator onboard a marine vessel.

2. Description of Related Art

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

Marine vessels are typically configured with a propulsion system powered by an internal combustion engine mounted within the vessel hull. Exhaust generated by the engine is commonly combined with cooling water and routed through exhaust conduit to the stem of the vessel where the exhaust is discharged through one or more exhaust ports formed at or near transom. One or more mufflers are installed within the exhaust duct(s) to silence noise associated with the engine and exhaust gases. A variety of structures are known in the background art for use in silencing marine exhaust noise. The present inventor has invented a number of novel marine exhaust components that have greatly improved the silencing and efficiency of marine exhaust systems.

In U.S. Pat. No. 5,262,600, the first named inventor herein disclosed an in-line insertion muffler for marine engines employing a first housing encompassing a second housing which is partitioned by an angularly disposed inner planar baffle that has proven extremely effective in reducing engine noise. In U.S. Pat. No. 5,444,196, the first named inventor herein disclosed an improved version of the in-line muffler having a corrugated sleeve disposed between in the first and second housings. In U.S. Pat. No. 5,625,173, the first named inventor herein disclosed a single baffle linear muffler with an angularly disposed baffle that may be planer, convex, or concave. In U.S. Pat. No. 7,581,620, the first named inventor herein disclosed a marine muffler comprising an elongate cylindrical housing having an inlet and an outlet, and an internal volume partitioned by an angularly disposed internal baffle into a lower chamber in communication with the inlet and an upper chamber in communication with the outlet. A centrally disposed duct passes through the baffle to allow exhaust gas and exhaust cooling water to flow from the lower inlet chamber to upper outlet chamber. The various linear mufflers made in accordance with the above-referenced patents have achieved tremendous success and widespread acceptance within the marine industry. Such muffler systems have been successfully installed on a wide variety of marine vessels having engines in excess of 1,000 horsepower.

An additional need exists in the art, however, for muffler systems specifically adapted for use with onboard marine electrical generators. The seawater used for cooling the generator motor is also injected into the exhaust stream to cool the exhaust gases. A muffler system is typically installed downstream of the generator exhaust outlet to silence exhaust noise. As used herein the term "wet exhaust" shall refer to the combination of exhaust gas generated by an internal combustion engine combined with entrained cooling water and/or water vapor, originating from the injection of cooling water into the exhaust stream. The increased use of diesel engines to power marine generators has brought additional challenges to the field of muffler designs. More particularly, diesel engines are known to produce exhaust with higher concentrations of combustion byproducts, e.g. soot. As a result, particulate filters are often installed in the exhaust system to remove said byproducts prior to discharging the exhaust from the vessel. These particulate filters consume 12.0"-18.0" (water column) of available exhaust backpressure leaving little available exhaust back pressure for use by the downstream muffler. As a result, there exists a need for a marine generator muffler capable of adequate silencing of diesel engine exhaust with minimal pressure drop.

Past marine generator muffler systems have comprised basic exhaust and cooling water handling components that have succeeded in routing the exhaust gas and cooling water but have failed to provide sufficient exhaust silencing and have been burdened with excessive back pressure. Accordingly, there exit a need for an improved water-drop muffler system specifically designed for use with marine generators, particularly diesel marine generators.

BRIEF SUMMARY OF THE INVENTION

The present invention overcomes limitations present in the art by providing an improved multi-chamber water-drop muffler for use with marine electrical generators installed onboard marine vessels. The multi-chamber water-drop muffler system of the present invention includes a housing having a wet exhaust inlet, a water outlet, and a dry exhaust outlet. The housing defines a main internal chamber including a lower portion divided by an angled baffle into a first stage inlet chamber disposed below the baffle, and a second stage water separation chamber disposed above the baffle. Vertically disposed, open-ended exhaust ducts are attached to opposing interior housing side walls and penetrate the angled baffle to allow exhaust gas and entrained cooling water to pass from the lower inlet chamber to the second stage water separation chamber. The velocity of the exhaust gas is such that it entrains any liquid water contained in the flow up through the exhaust ducts and into the second chamber. Duct outlet caps may be selectively provided and positioned to allow the muffler to be tuned to the specific application. Water collected within the water separation chamber may exit the housing via the water outlet. The second stage water separation chamber is bounded at the top thereof by a horizontally disposed concave (when viewed from below) cap that functions as a second baffle to terminate the upward flow of exhaust gas and redirect the exhaust downward. A pair of semi-circular, open-ended tubes are attached to opposing interior hosing front and rear walls and extend through the second baffle thereby allowing exhaust to pass upward through the second baffle and into a third chamber. The third chamber is disposed above the second baffle and is bounded at the top by a convex (when viewed from below) third baffle. The third baffle defines a plurality of slotted apertures which allow exhaust gas and any remaining entrained cooling water to flow through apertures into an upper fourth chamber located at the top of the housing interior and in fluid communication with the exhaust outlet. Any water separated from the exhaust gas within the various housing chambers ultimately finds its way into the second chamber and is directed to the water outlet for discharge.

Accordingly, it is an object of the present invention to provide an improved marine water drop muffler.

It is another object of the present invention to provide a water drop muffler having a very low pressure drop rating.

Still another object of the present invention is to provide a water drop muffler particularly suitable for use with diesel marine generators.

Yet another object of the present invention is to provide such a muffler that is tunable to maximize exhaust silencing and backpressure performance.

In accordance with these and other objects, which will become apparent hereinafter, the instant invention will now be described with particular reference to the accompanying drawings.

DETAILED DESCRIPTION OF THE INVENTION

Figure 1:
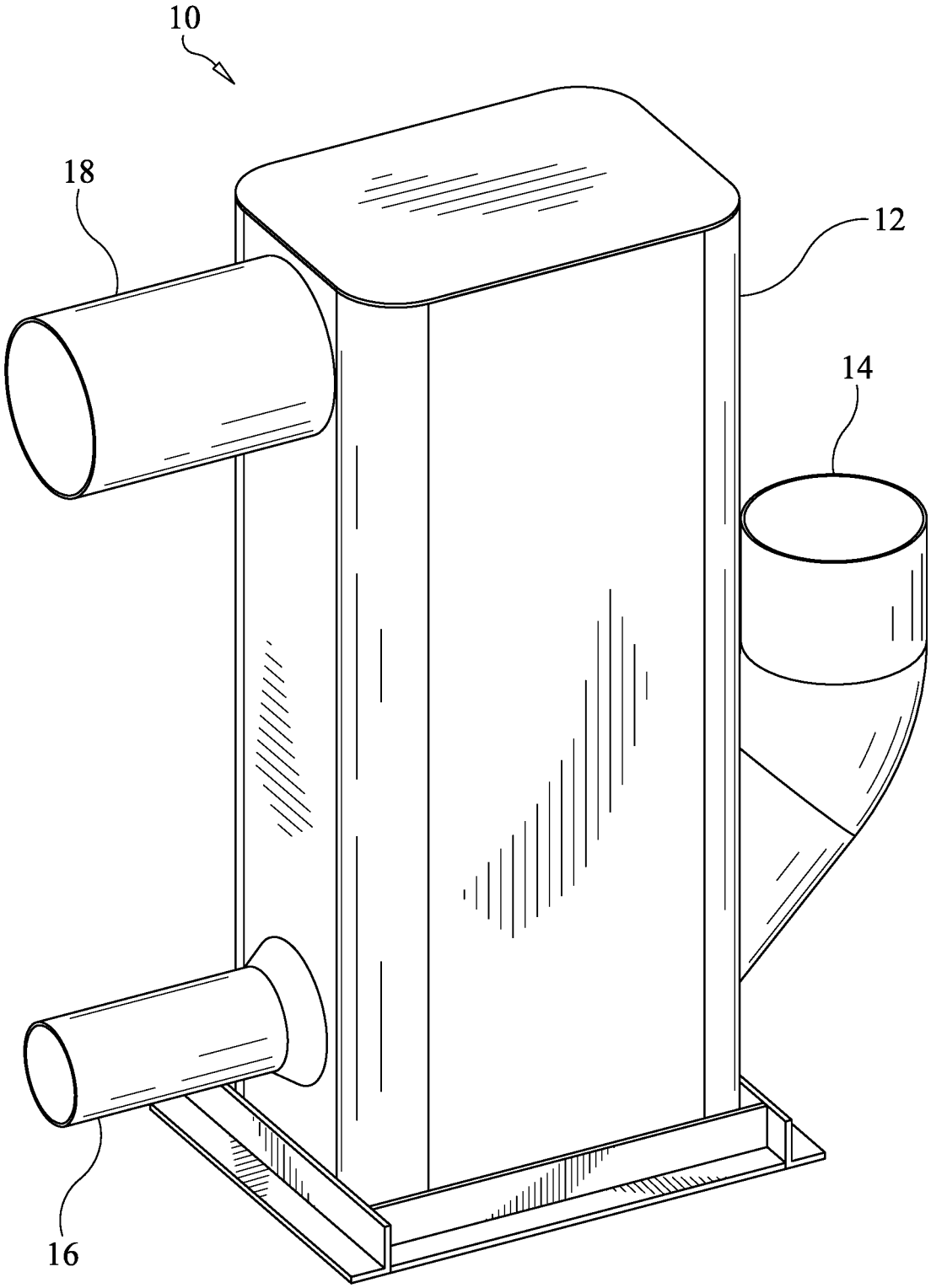
FIG. 1 is a top front perspective view of a marine muffler in accordance with the present invention.
Figure 2:
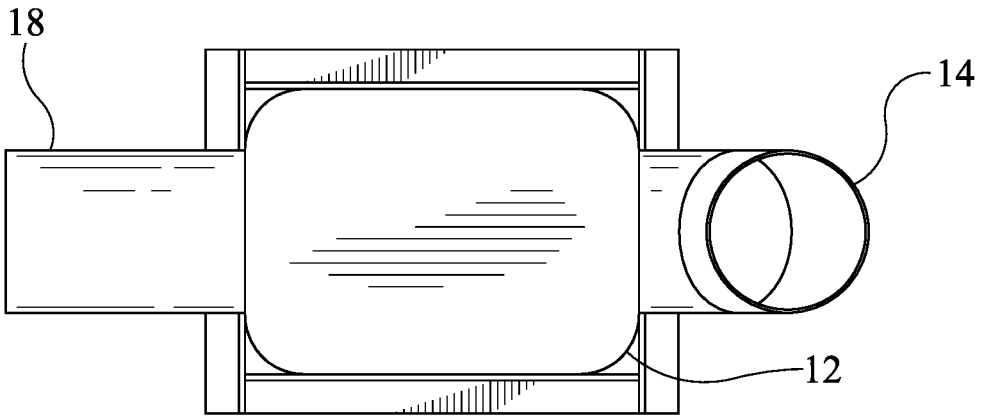
FIG. 2 is a top view thereof.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

In describing this invention, the word "affixed" is used. By "affixed" is meant that the article or structure referred to is joined, either directly, or indirectly, to another article or structure. By "indirectly joined" is meant that there may be an intervening article or structure imposed between the two articles which are "affixed". "Directly joined" means that the two articles or structures are in contact with one another or are essentially continuous with one another. By adjacent to a structure is meant that the location is near the identified structure.

Turning now to the drawings FIGS. 1-7 illustrate a multi-chamber water-drop marine muffler, generally referenced as 10, in accordance with the present invention. Muffler 10 is well suited for use with water-cooled marine generators, and particularly with diesel powered marine generators which require a muffler having very low backpressure, due to the use of diesel particulate filters which consume a significant amount of the backpressure allotment to remove soot from the exhaust upstream of the muffler. Muffler 10 is generally characterized as a water-drop muffler as its structure is designed to separate cooling water that enters the muffler entrained with the exhaust gas. Accordingly, as more fully explained below, muffler 10 has a wet exhaust inlet, a dry exhaust outlet, and a water outlet.

Marine muffler 10 includes a housing, generally referenced as 12, having a wet exhaust inlet 14, a water outlet 16, and a dry exhaust outlet 18. Housing 12 is preferably fabricated from heat resistant fiberglass, however, any suitable material is considered within the scope of the present invention. Housing 12 further includes a bottom adapted with a convex (when viewed from above) structure 13 and a top adapted with a concave (when viewed from below) structure 15, both of which function to minimize exhaust-pulse induced vibration. In addition, housing 12 is typically installed in a marine vessel and connected to an exhaust producing device, such as a water-cooled diesel-powered marine generator, which discharges hot exhaust gas carrying entrained cooling water. Accordingly, wet exhaust inlet 14 is connected in fluid communication to receive a combination of exhaust gas and entrained cooling water, and potentially other particulate matter discharged by the exhaust producing device, such as a diesel-powered marine generator.

Figure 3:
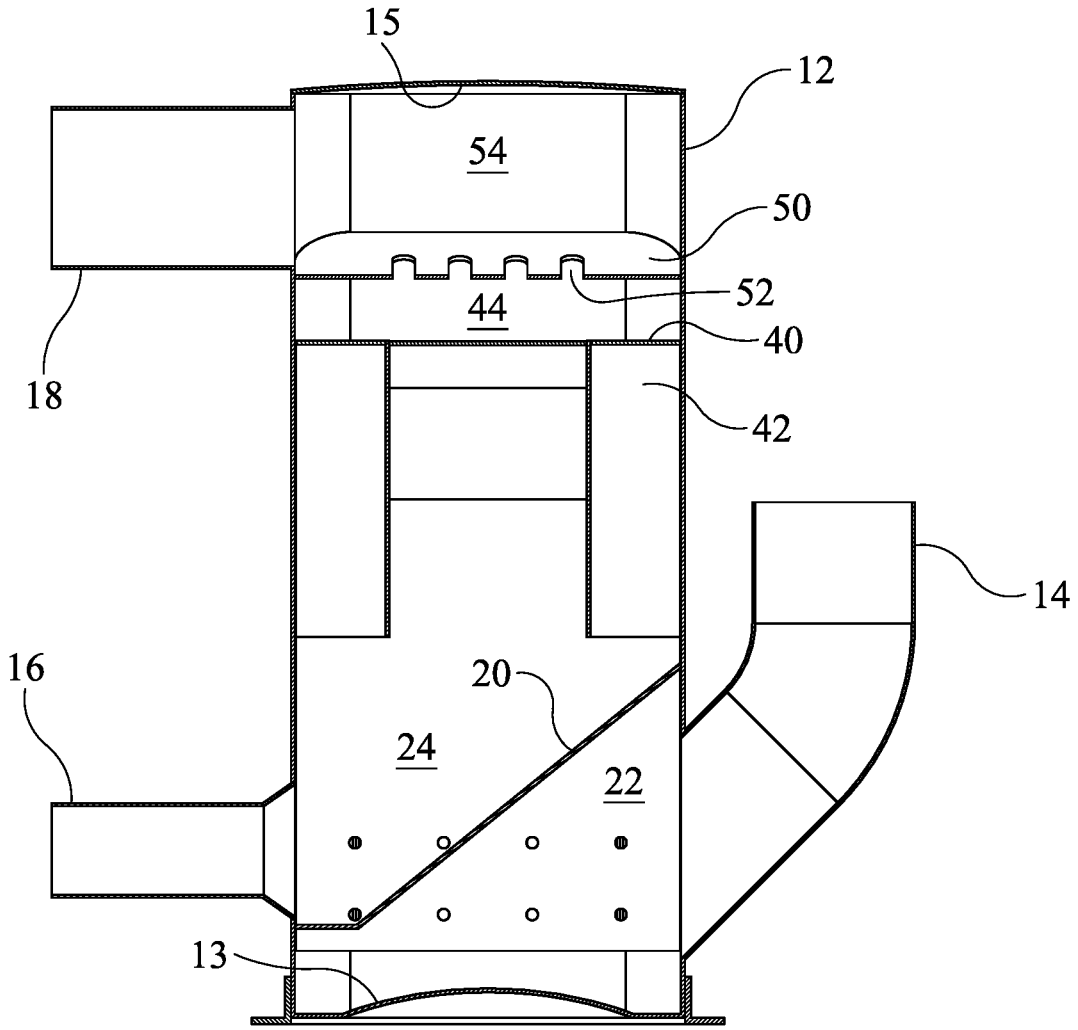
FIG. 3 is a front sectional view thereof.
Figure 4:
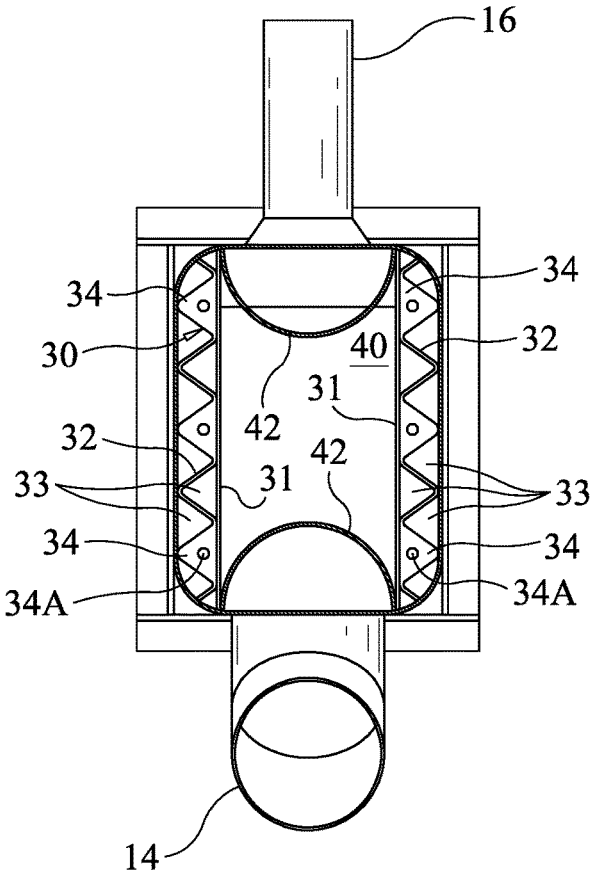
FIG. 4 is a top sectional view thereof.
Figure 7:
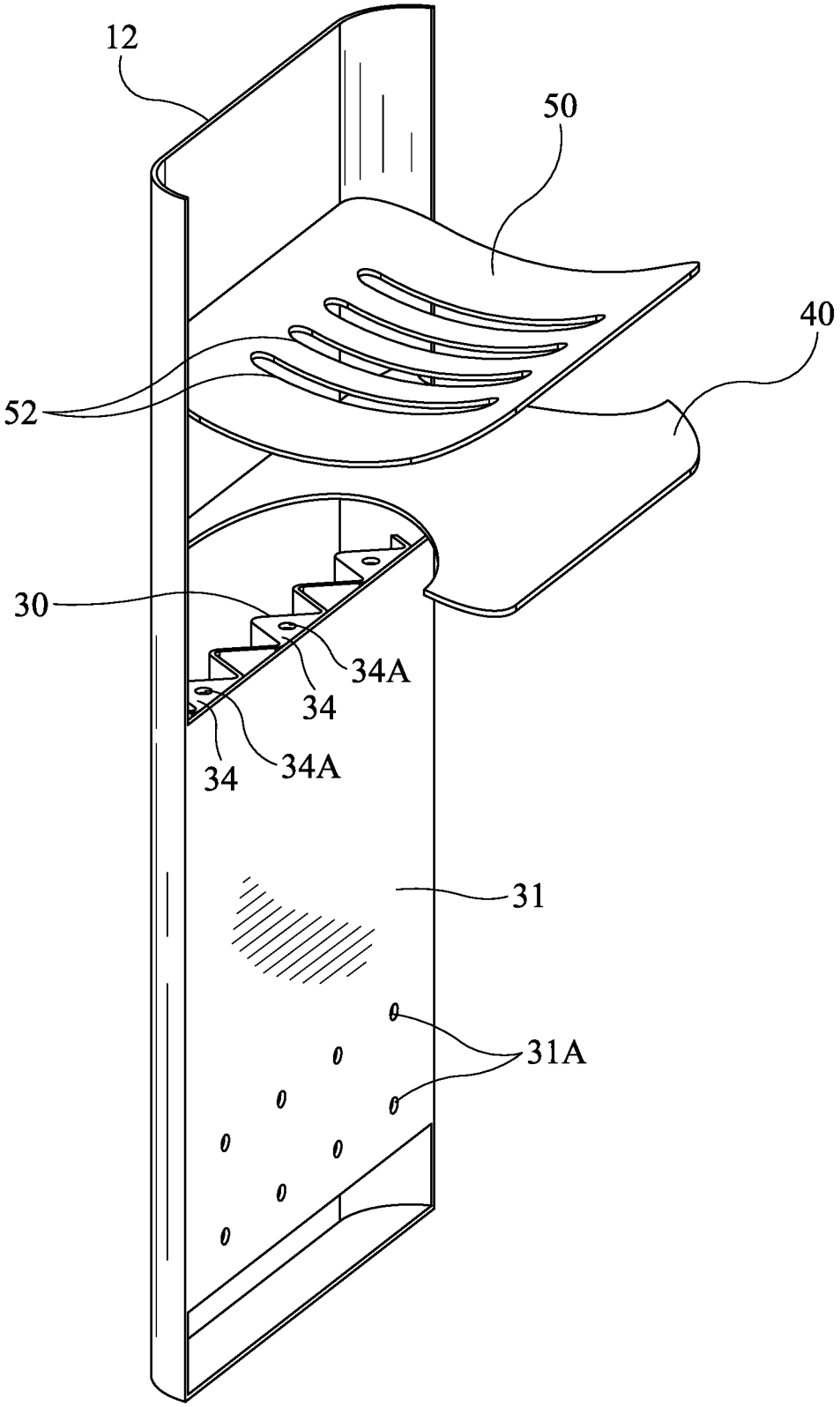
FIG. 7 is a partial sectional view thereof.

As best seen in FIG. 3, housing 12 defines an internal volume including a lower portion divided by an angularly disposed baffle 20 into a lower first chamber 22 disposed below baffle 20, and a second chamber 24 disposed above baffle 20. Baffle 20 has its peripheral edges sealingly affixed to the inner housing walls and other internal structure. A pair of vertically disposed open-ended exhaust ducts 30 penetrate baffle 20. Exhaust ducts 30 are affixed to opposing interior housing side walls with the lowermost ends thereof in vertically spaced relation with the housing floor (e.g. structure 13). Exhaust ducts 30 function to allow exhaust gas and entrained cooling water to pass from the lower first chamber 22 to the upper second chamber 24. Each exhaust duct 30 includes a corrugated member 32 that divides the duct into a plurality of subducts, referenced as 33 as illustrated in FIG. 4. Subducts 33 preferably define a generally triangular cross-section, however, any suitable geometric configuration is considered within the 20 scope of the present invention. The corrugated members 32 of exhaust ducts 30 further function to stiffen the housing front and rear walls thereby improving silencing by minimizing wall vibration. As seen in FIG. 7, exhaust ducts 30 include a planar inner wall 31 that may include one or more apertures 31A disposed at the lower end thereof to facilitate muffler tuning and the entrainment of water upward through the exhaust duct. One or more subducts 33 may further be adapted with a cap 34 coupled to the top thereof as best seen in FIG. 4. Duct caps 34 function to allow the muffler to be tuned for a specific application, namely, for specific horsepower applications. Duct caps 34 may further define one or more thru bores 34A therein to further facilitate fine tuning of the muffler. Exhaust gas flow, upon exiting ducts 30 into second chamber 24, decelerates thereby allowing entrained cooling water to separate from the exhaust gas. As best seen in FIG. 3, baffle 20 is downwardly sloped toward water outlet 16 such that any water collected within the second/water separation chamber 24 is permitted to exit housing 12.

Figure 5:
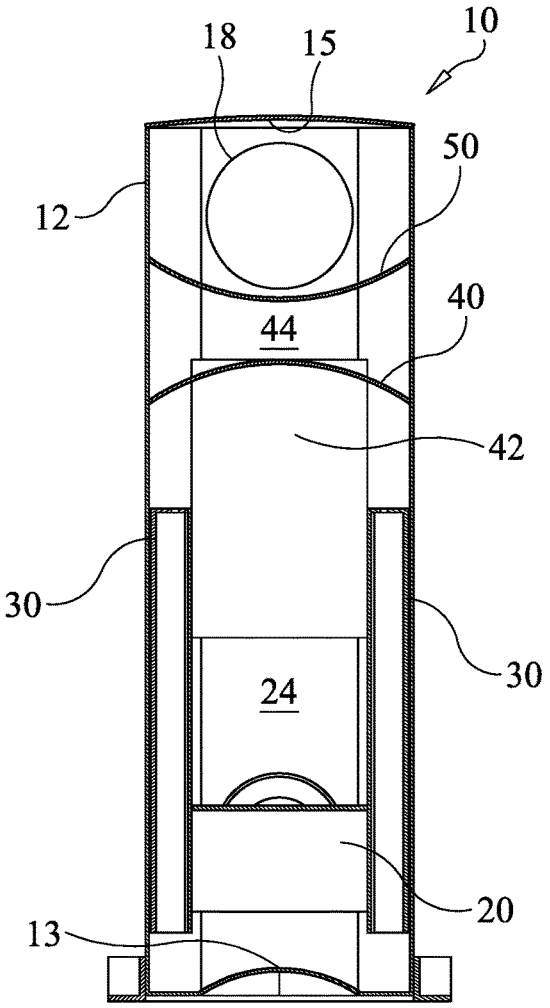
FIG. 5 is a side sectional view thereof.
Figure 6:
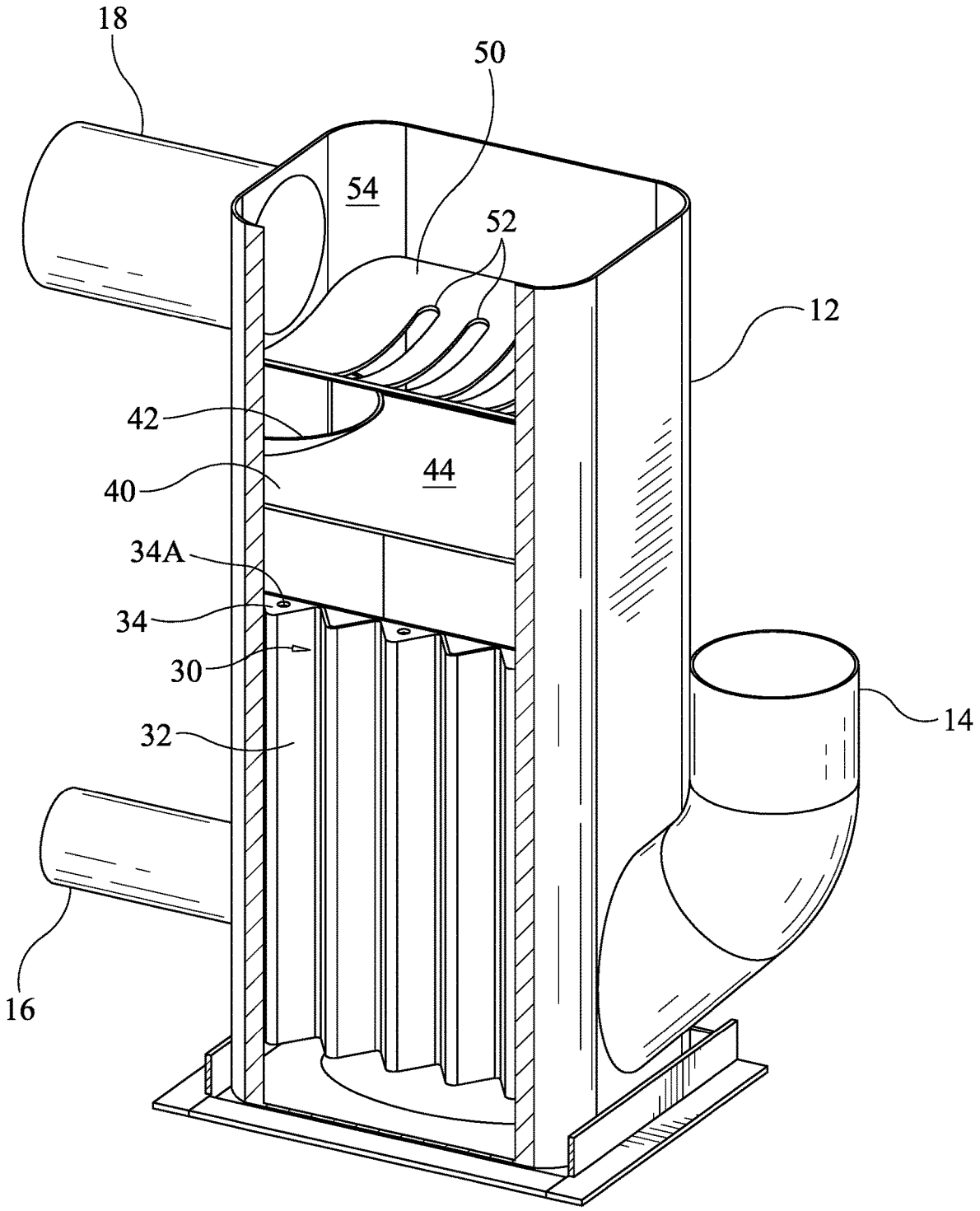
FIG. 6 is a front view thereof with the front wall shown in section.

As best seen in FIGS. 3 and 5, second chamber 24 is bounded at the uppermost portion thereof by a second baffle 40. Second baffle 40 is formed by a horizontally disposed concave (when viewed from below) baffle structure that functions as a deceleration cap to terminate the upward flow of exhaust thereby redirecting the exhaust downward. Second baffle 40 has a peripheral edge sealingly affixed to the interior housing wall and/or other internal structure. Exhaust conduits 42, formed by a pair of semi-circular vertically disposed open-ended tubes, are affixed to opposing interior hosing front and rear walls and extend through second baffle 40 thereby allowing exhaust to pass upward through second baffle 40. While exhaust conduits 42 are disclosed a semi-circular, tubular members any suitable exhaust conduit shape or configuration is considered within the scope of the present invention. A third chamber 44 is disposed above the second baffle 40 and is bounded at the uppermost portion by a convex (when viewed from below) third baffle 50. Third baffle 50 has a peripheral edge sealingly affixed to the interior housing wall. Third baffle 50 further defines a plurality of slotted apertures 52 that allow for now generally dry exhaust to pass upward into a fourth outlet chamber 54 located at the top of the housing interior and in fluid communication with the exhaust outlet 18 whereby the exhaust may exit housing 12.

A significant aspect of the present invention involves the ability to tune muffler performance by selectively closing or capping the top portions of one or more subducts 33 with a cap 34, as illustrated in FIG. 3. Capping one or more of the subducts 33 modifies exhaust flow dynamics through the muffler resulting corresponding changes in sound suppression and backpressure. A further significant aspect of the present invention involves adapting the caps 34 and/or the wall of exhaust duct 30 with relatively small apertures 34A, which has proven effective in reducing noise and backpressure by altering exhaust gas flow dynamics. By selectively capping one or more conduits and/or varying the size and number of aperture, the muffler can be tuned for maximum performance and silencing.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A marine muffler comprising:

a housing defining an internal volume, said housing including a wet exhaust inlet, a water outlet, and an exhaust outlet;

a first internal baffle dividing a lower portion of said internal volume into first chamber disposed below said baffle and a second chamber disposed above said baffle;

said first chamber in fluid communication with said wet exhaust inlet;

said second chamber in fluid communication with said water outlet;

at least one vertically disposed open-ended exhaust duct having a lower end in fluid communication with said first chamber and an upper end in fluid communication with said second chamber, whereby wet exhaust is permitted to flow through said duct from said first chamber to said second chamber;

said second chamber bounded at the upper end thereof by a second baffle;

at least one exhaust conduit having a lower end in fluid communication with said second chamber and an upper end extending through said second baffle to allow exhaust to pass upward from said second chamber into a third chamber;

said third chamber is bounded at the upper end thereof by a third baffle, said third baffle defining at least one aperture whereby exhaust is permitted to flow through said third baffle into a fourth chamber, and said fourth chamber in fluid communication with said exhaust outlet; and said third chamber in fluid communication with said exhaust outlet.

2. The marine muffler according to claim 1 wherein said housing includes a bottom adapted with a convex stiffener and a top adapted with a concave stiffener.

3. The marine muffler according to claim 1 wherein each of said exhaust ducts includes a corrugated member that divides the duct into a plurality of subducts.

4. The marine muffler according to claim 1 wherein said second baffle is convex when viewed from below.

5. The marine muffler according to claim 1 wherein said third baffle is concave when viewed from above.

6. A marine muffler comprising:

a housing defining an internal volume, said housing including a wet exhaust inlet, a water outlet, and an exhaust outlet;

an internal baffle dividing a lower portion of said internal volume into first chamber disposed below said baffle and a second chamber disposed above said baffle;

said first chamber in fluid communication with said wet exhaust inlet;

said second chamber in fluid communication with said water outlet;

a pair of vertically disposed open-ended exhaust ducts affixed to opposing interior housing side walls, each of said exhaust ducts having a lower end in fluid communication with said first chamber and an upper end in fluid communication with said second chamber, whereby wet exhaust is permitted to flow through said ducts from said first chamber to said second chamber;

said second chamber bounded at the upper end thereof by a second baffle;

a pair of semi-circular vertically disposed open-ended tubes are affixed to opposing interior housing front and rear walls, each of said tubes having a lower end in fluid communication with said second chamber and an upper end extending through said second baffle thereby allowing exhaust to pass upward from said second chamber into a third chamber;

said third chamber bounded at the upper end thereof by a third baffle;

said third baffle defining at least one aperture whereby exhaust is permitted to flow through said third baffle into a fourth chamber; and said fourth chamber in fluid communication with said exhaust outlet.

7. The marine muffler according to claim 6 wherein said housing includes a bottom adapted with a convex stiffener and a top adapted with a concave stiffener.

8. The marine muffler according to claim 6 wherein each of said exhaust ducts includes a corrugated member that divides the duct into a plurality of subducts.

9. The marine muffler according to claim 6 wherein said second baffle is convex when viewed from below.

10. The marine muffler according to claim 6 wherein said third baffle is concave when viewed from above.

11. The marine muffler according to claim 6 wherein at least a portion of said exhaust ducts sealed off by at least one cap.

12. The marine muffler according to claim 11 wherein said at least one cap defines an aperture.

13. A marine muffler comprising:

a housing defining an internal volume, said housing including a wet exhaust inlet, a water outlet, and an exhaust outlet;

a first internal baffle dividing a lower portion of said internal volume into first chamber disposed below said baffle and a second chamber disposed above said baffle;

said first chamber in fluid communication with said wet exhaust inlet;

said second chamber in fluid communication with said water outlet;

at least one vertically disposed open-ended exhaust duct having a lower end in fluid communication with said first chamber and an upper end in fluid communication with said second chamber, whereby wet exhaust is permitted to flow through said duct from said first chamber to said second chamber;

each of said exhaust ducts includes a corrugated member that divides the duct into a plurality of subducts;

said second chamber bounded at the upper end thereof by a second baffle;

at least one exhaust conduit having a lower end in fluid communication with said second chamber and an upper end extending through said second baffle to allow exhaust to pass upward from said second chamber into a third chamber; and said third chamber in fluid communication with said exhaust outlet.

* * * * *